US006758445B2

(12) United States Patent
Click et al.

(10) Patent No.: US 6,758,445 B2
(45) Date of Patent: Jul. 6, 2004

(54) REPLACEABLE POINT FROG

(75) Inventors: Gary Click, Birmingham, AL (US); Allen James Tuningley, South Surrey (CA)

(73) Assignee: VAE Nortrak North America Inc., Cheyenne, WY (US)

( * ) Notice: Subject to any disclaimer, the term of this patent is extended or adjusted under 35 U.S.C. 154(b) by 0 days.

(21) Appl. No.: 10/290,565

(22) Filed: Nov. 7, 2002

(65) Prior Publication Data

US 2003/0222182 A1 Dec. 4, 2003

(30) Foreign Application Priority Data

May 29, 2002 (CA) ..... 2387850

(51) Int. Cl.[7] ..... E01B 7/00
(52) U.S. Cl. ..... 246/468; 246/472
(58) Field of Search ..... 246/268, 472, 246/457, 455, 454, 460, 468, 461, 469, 462, 464, 470, 458, 388; 29/527.6, 894.1

(56) References Cited

U.S. PATENT DOCUMENTS

| | | | | | |
|---|---|---|---|---|---|
| 690,336 | A | * | 12/1901 | Wharton et al. | 246/460 |
| 988,909 | A | * | 4/1911 | Strong et al. | 246/460 |
| 4,824,055 | A | * | 4/1989 | Tuningley et al. | 246/458 |
| 5,598,993 | A | * | 2/1997 | Kuhn et al. | 246/468 |

* cited by examiner

*Primary Examiner*—Frantz F. Jules
(74) *Attorney, Agent, or Firm*—Glenn Patent Group; Michael A. Glenn

(57) ABSTRACT

A railway frog insert assembly comprises a casting defining the heel and toe sections of a frog. The portion of the casting intermediate the heel and toe sections consists of an integral spine extending between the heel and toe sections. The height of the spine is below the level of the flangeways in the vicinity of the point. An intermediate point section, the base of which is hollowed out, is removably seated over the spine. The top surface of the intermediate section defines the point, a small portion to the toe side of the point, a small portion to the heel side of the point, and the flangeways in the vicinity of the point.

10 Claims, 4 Drawing Sheets

REPLACEABLE POINT FROG

FIELD OF THE INVENTION

This invention relates to railway frogs.

BACKGROUND OF THE INVENTION

It is well known that railway frogs are subject to extreme wear as a result of the weight of passing trains and the impact of the wheels on various parts of the frog. For example the point of frog, the area of the guards, and the heel and toe end transitions are subjected to significant impact and damage, with the point suffering notably more wear damage than the other parts. The cost of repair and replacement of the frogs is significant.

Various attempts have been made to make frogs more resistant to the stresses they undergo and to simplify their replacement.

One approach has been to provide a cast frog insert that is made of a high solidity material such as a manganese alloy. Due to the high cost of such alloys, various designs of cast inserts have in turn been developed in an attempt to minimize the size of the casting required while still retaining the structural integrity of the frog and the ability to secure it, typically by bolts, in place between the running rails.

Another approach has been to provide a welded boltless manganese frog that eliminates rail joints in order to minimize transition wear and hence to minimize the need to replace the frog.

It is also known to provide a form of welded boltless manganese frog that has a truncated heel end and a welded non-manganese heel extension to further minimize the amount of manganese alloy required in the frog but still provide the ability to weld the frog to running rails in the field.

All of such prior art relies on a unitary toe to heel structure that, while shaped and tailored to minimize its length, and to minimize rail joints and improve the ease of replacement, nonetheless must be completely replaced when worn. The present invention seeks to further minimize the cost and difficulty of repairing a frog insert and to obviate the need to replace the entire casting.

This and other objects of the invention will be better understood by reference to the detailed description of the preferred embodiment which follows.

SUMMARY OF THE INVENTION

In considering approaches to solving the problems presented by the prior art, the inventors first conceived of providing a removable point that would be seated on a protrusion rising from the flangeways of the casting. However, it was found that the secure retention of the removable point on the casting presented a problem. Combined with the impact stresses to which the removable point was subjected, the result was plastic deformation of the element and difficulty in effectively replacing it. The solution of the present invention elegantly resolves this difficulty.

A frog insert assembly according to one aspect of the invention comprises a casting defining the heel and toe sections of a frog. The portion of the casting intermediate the heel and toe sections consists of an integral spine extending between the heel and toe sections. An intermediate point section, the base of which is hollowed out, is removably seated on the spine. The top surface of the intermediate section defines the point, a small portion to the toe side of the point, a small portion to the heel side of the point, and the flangeways in the vicinity of the point.

The frog assembly is mounted on a base plate, for example by means of clips or hold-downs. In the preferred embodiment, the clips or hold-downs are used on the heel and toe sections of the casting, as well as on the removable intermediate section, while the spine itself is not directly restrained.

In order to accommodate an intermediate section that can define the flangeways, the spine is preferably of a height that is less than the height of the flangeways in relation to the base plate. Preferably the difference between the heights is at least 3.5 cm.

The heel and toe ends of the intermediate section as well as the mating portions of the heel and toe sections of the casting that face the intermediate section are preferably mitred to ensure proper and snug positioning of the intermediate piece and to minimize wear at the transition.

In another embodiment of the invention, the heel and toe sections of the frog are cast separately along with a separate spine and a separate removable intermediate piece.

In one aspect, the invention comprises a railway frog insert assembly comprising a casting defining the heel and toe sections of a frog and having an integral spine extending between said heel and toe sections, and an intermediate section removably seatable over the spine between the heel and toe sections.

In another aspect of the invention, the intermediate section also comprises a top surface defining a point and a flangeway adjacent each side of the point.

In yet another aspect, the top surface further defines portions of a frog, said portions including a portion of the frog to the toe side of the point, a portion of the frog to the heel side of the point, and at least a portion of a flangeway on the toe side of the point.

In another aspect, the frog insert assembly comprises a casting defining the heel and toe sections of a frog and having an integral spine extending between the heel and toe sections, and an intermediate section removably seatable over the spine between the heel and toe sections. The intermediate section includes a base with a hollowed out channel, and the intermediate section is removably seatable over the spine by seating the channel over the spine.

In another aspect, the previously referenced top surface defines at least a point and a flangeway adjacent each side of the point. In a further aspect, it also defines a portion of the frog to the toe side of the point, a portion of the frog to the heel side of the point, and at least a portion of a flangeway on the toe side of the point.

In another aspect of the invention, the intermediate section includes a top surface, a base having two sides and a lateral extension extending from each of said sides of the base.

In yet a further aspect, the invention comprises a frog assembly comprising a base plate, the frog insert assembly as described above and a plurality of retainers engaging each of said heel section, said toe section and said extensions to the base plate. Preferably the spine is not retained in engagement to the base plate.

In yet another aspect, the invention comprises a frog insert assembly according to any of the aspects described above, wherein the heel and toe ends of the intermediate section have mitred cuts, and the facing heel and toe sections of the assembly have corresponding mitred cuts.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE PREFERRED EMBODIMENT

A detailed description of the preferred embodiment will be provided by reference to the drawings thereof and of the prior art, in which.

DETAILED DESCRIPTION OF THE PREFERRED EMBODIMENT

Figure 1:
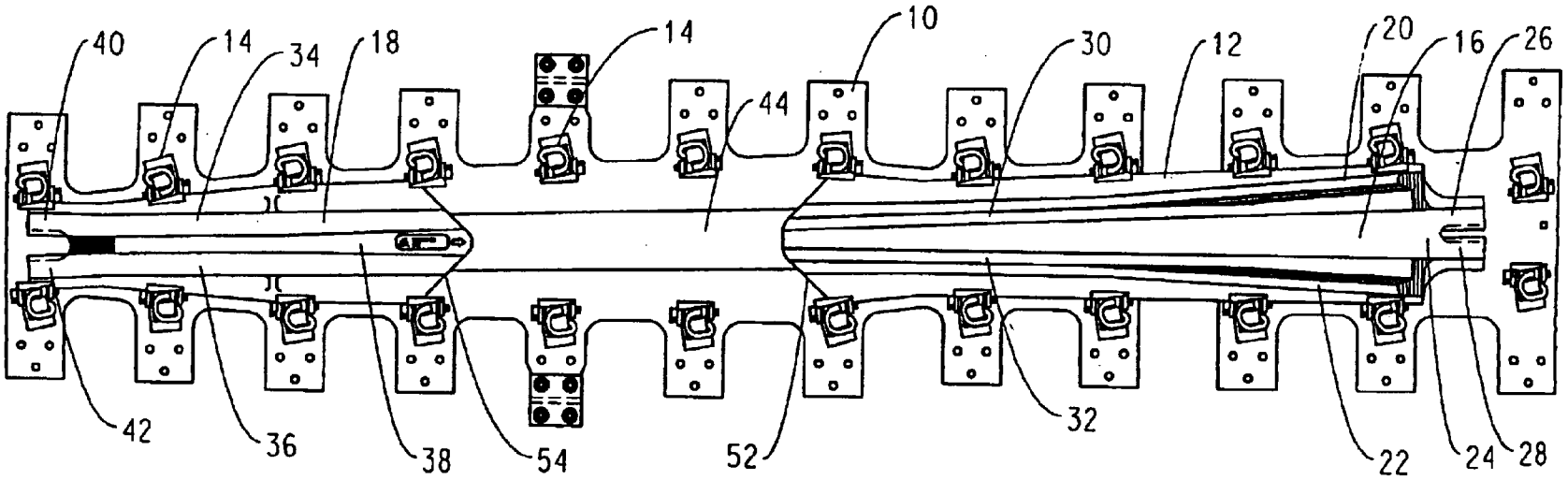
FIG. 1 is a plan view of the frog assembly according to the preferred embodiment, mounted on a base plate, but without the removable intermediate section.

Referring to FIG. 1, there is shown a base plate 10, a casting 12 and a plurality of retainers or clips 14.

Casting 12 is preferably of a manganese steel alloy as is known for frog castings. Casting 12 includes a heel section 16 and a toe section 18. Heel section 16 defines guards 20, 22, heel 24, heel rail extensions 26, 28 and the heel side flangeways 30, 32.

Toe section 18 defines running surfaces 34, 36, flangeway 38 and toe rail extensions 40, 42.

Figure 2:
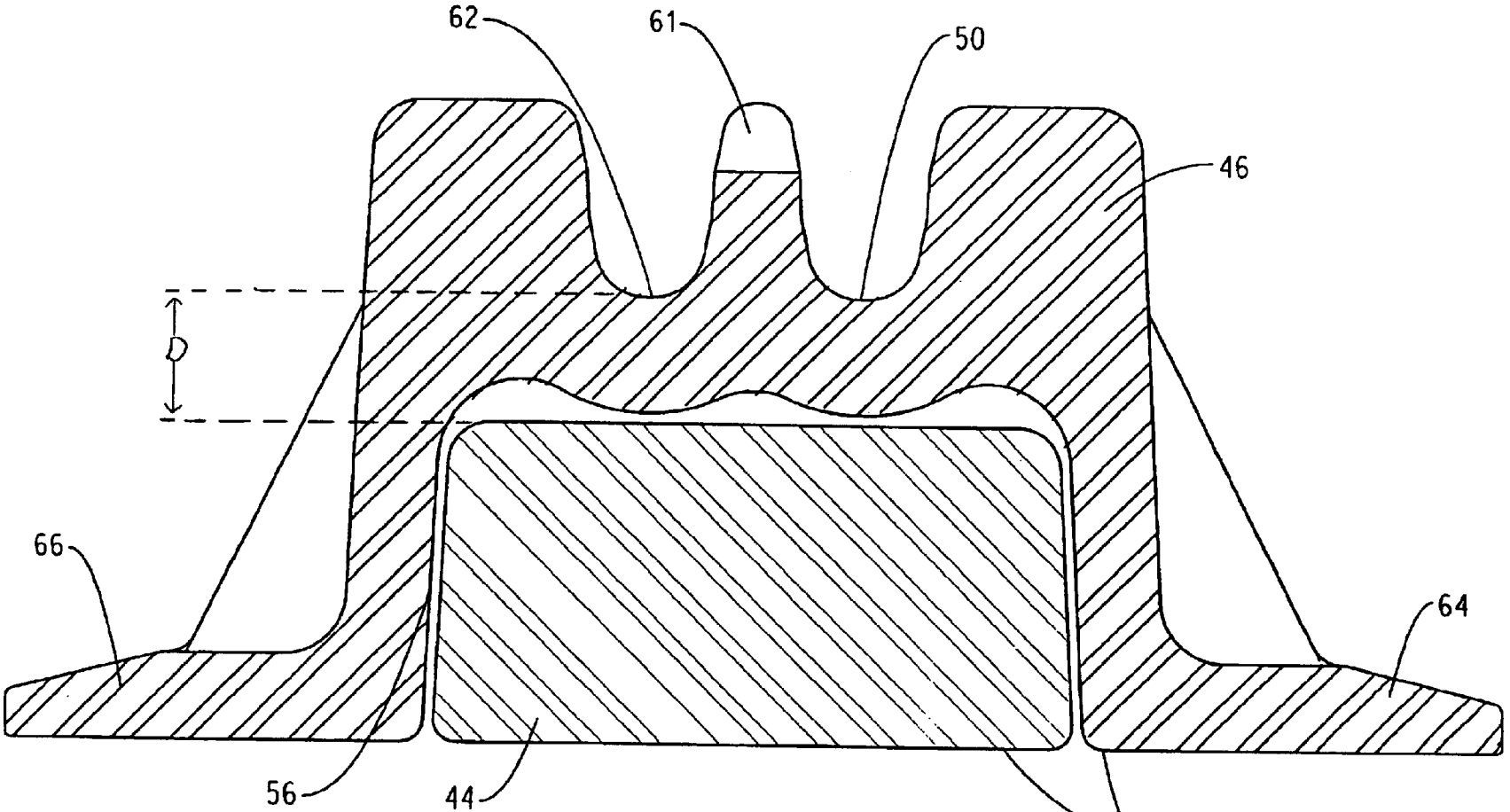
FIG. 2 is a cross-sectional view taken along line 2—2 of FIG. 4 showing the spine and the removable intermediate section, but excluding the base plate.

A spine 44 extends between heel section 16 and toe section 18 and is cast integrally therebetween. Referring to FIG. 2, spine 44 may for example a generally rectangular in cross-section with a slight upward taper.

FIG. 2 also provides a cross-sectional view of the removable intermediate point section 46 seated over the spine 44. As can be seen, the height of spine 44 above the base 48 of the spine (which coincides with the base of the casting) is less than the height of the flangeway 50 (adjacent the point) above the base. Preferably the difference in height, D, is at least 3.5 cm.

Figure 3:
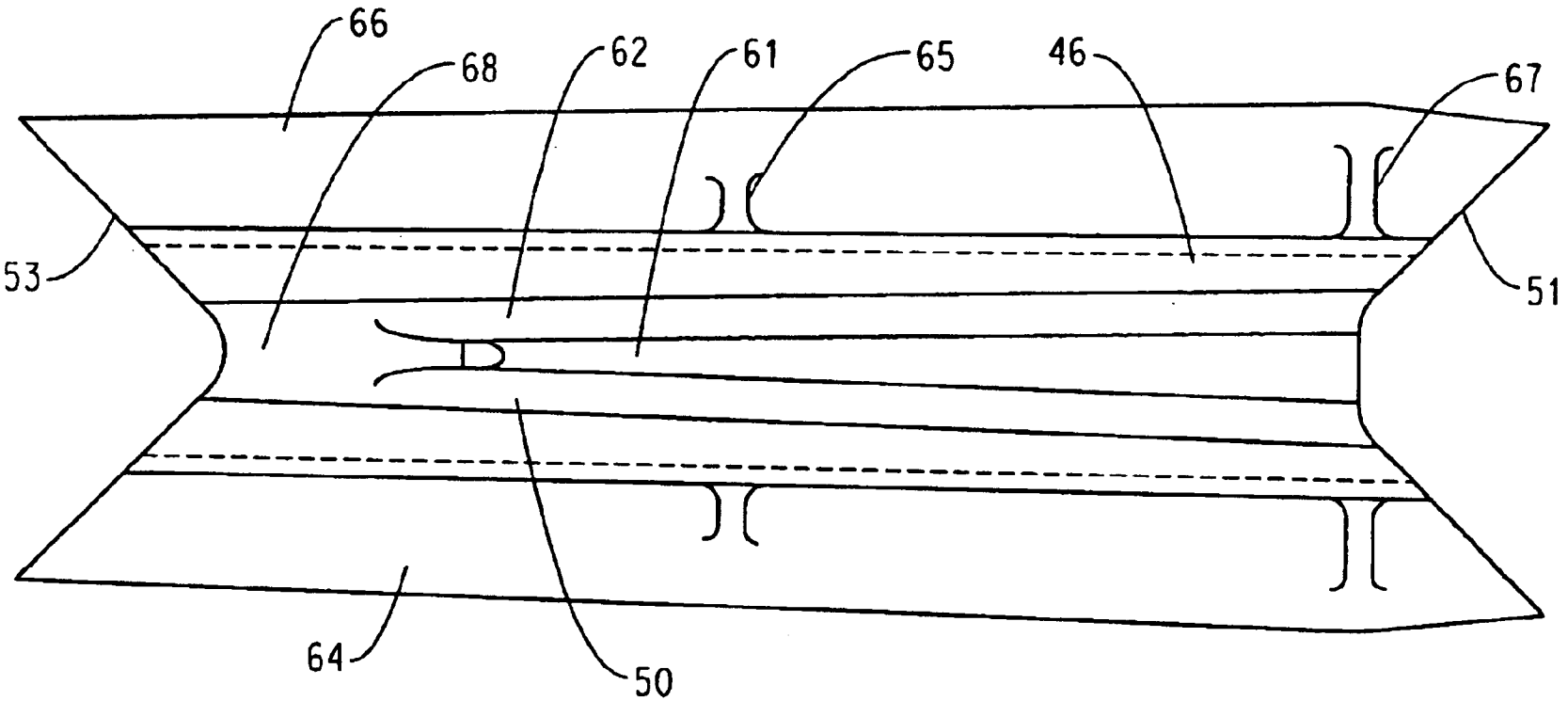
FIG. 3 is a plan view of the removable intermediate section.
Figure 4:
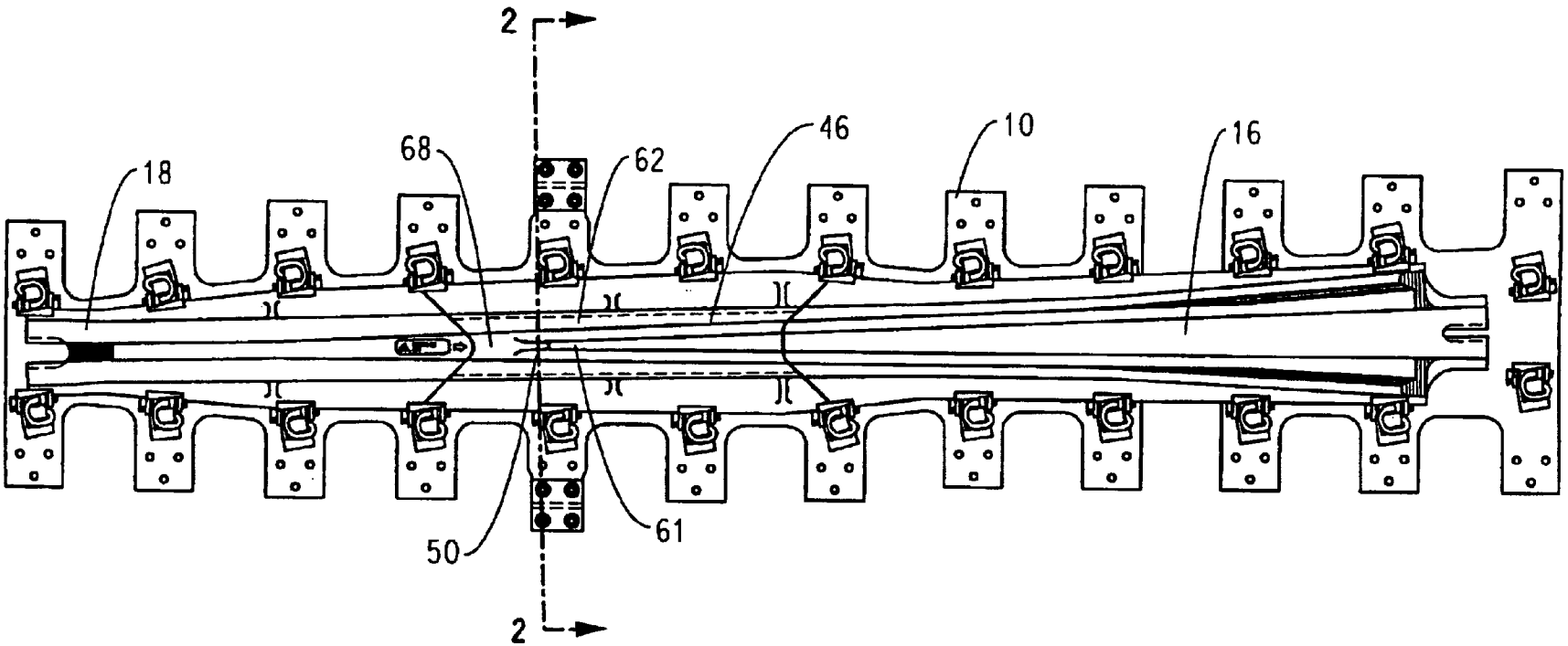
FIG. 4 is a plan view of the assembly mounted on a base plate and including the removable intermediate section.

Referring again to FIG. 1, the inwardly facing ends 52, 54 of the heel and toe sections 16, 18 respectively are formed with mitred cuts. FIG. 4 shows the assembly including the removable intermediate section 46 seated on spine 44 while FIG. 3 shows the removable intermediate section 46 only. The heel and toe ends of section 46 are similarly provided with mitred cuts 51, 53 corresponding to those on ends 52, 54 of the heel and toe sections 16, 18 of the assembly. The cuts are formed to ensure a snug abutting fit of the intermediate section 46 between the heel and toe sections 16, 18.

Referring again to FIG. 2, the base of intermediate section 46 is hollowed out as at 56 so as to accommodate the spine 44.

Removable intermediate section 46 is also provided with lateral base extensions 64, 66 to both support the intermediate section and to provide a surface for engagement of clips 14 as illustrated in FIG. 4. There are further provided integral shoulder braces 65 and 67 to provide a lateral bracing for the elevated portions of intermediate section 46.

The top surface of the intermediate section 46 defines the point 61, a small portion to the toe side of the point and a small portion to the heel side of the point. For example, for a No. 20 frog illustrated in the drawings, the toe side of the intermediate section 46 extends about 10 inches from the ½ inch point and the heel side extends about 30 inches from the ½ inch point. The top surface of the intermediate section 46 also defines the flangeways 50, 62 and 68 in the vicinity of the point, including at least a portion of the flangeway on the toe side of the point. It will be appreciated that for different angles of frog, different sizes of replaceable intermediate section 46 will be possible, and hence different extents to the toe and heel sides of the point will be encompassed by the intermediate section 46.

Replacement of the removable intermediate section 46 in the field is straightforward. Clips 14 retaining the intermediate section 46 to the base plate 10 are removed and the intermediate section 46 is lifted out of its seat, and replaced with a new section 46. As the point is the area of the frog most affected by wear, the invention allows the replacement of the key part of the frog without requiring the replacement of the entire frog. There results a saving in relatively expensive manganese, and greater ease of repair and replacement of the relatively smaller element.

An additional advantage of the invention is that it allows the use of an impact-resistant alloy (such as manganese steel) for the replaceable intermediate section, while allowing the balance of the casting to be cast from a cheaper wear-resistant material such as rail steel.

The above description has been intended to illustrate the preferred and alternative embodiments of the invention. It will be appreciated that modifications and adaptations to such embodiments may be practised without departing from the scope of the invention, such scope being most properly defined by reference to this specification as a whole and to the following claims.

What is claimed is:

1. A railway frog insert assembly comprising:

a casting defining heel and toe sections of a frog and having an integral spine extending between said heel and toe sections;

an intermediate section removably seatable over said spine between said heel and toe sections;

wherein said intermediate section includes a top surface, a base having two sides and a lateral extension extending from each of said sides of said base.

2. The frog insert assembly of claim 1 further comprising a base plate and a plurality of retainers engaging each of said heel section, said toe section and said extensions to said base plate.

3. The frog insert assembly of claim 2 wherein said spine is not retained in engagement to said base plate.

4. The frog insert assembly of claim 1 wherein said intermediate section abuts a toe end of said heel section about a heel end of said intermediate section, and said intermediate section abuts a heel end of said toe section about a toe end of said intermediate section.

5. The frog insert assembly of claim 1 wherein said intermediate section has a toe end and a heel end each having a mitred cut, and a toe end of said heel section and a heel end of said toe section each have mitred cuts corresponding to the said mitred cuts of said intermediate section.

6. The frog insert assembly of claim 1 wherein said top surface defines at least a point having two sides and a flangeway adjacent each side of said point.

7. The frog insert assembly of claim 6 wherein said point has a toe side and a heel side, and wherein said top surface further defining portions of a frog, said portions including a portion of the frog to the toe side of the point, a portion of the frog to the heel side of the point, and at least a portion of a flangeway on the toe side of said point.

8. The frog insert assembly of claim 1 wherein said base including a hollowed out channel, said intermediate section being removably seatable over said spine by seating said channel over said spine.

9. The frog insert assembly of claim 8 wherein said top surface defines at least a point having two sides and a flangeway adjacent each side of said point.

10. The frog insert assembly of claim 9 wherein said point has a toe side and a heel side, and wherein said top surface further defines portions of a frog, said portions including a portion of the frog to the toe side of the point, a portion of the frog to the heel side of the point, and at least a portion of a flangeway on the toe side of said point.

* * * * *